United States Patent [19]

Fisher et al.

[11] 3,943,048

[45] Mar. 9, 1976

[54] POWDER ANODE

[75] Inventors: Gordon L. Fisher, Mahwah, N.J.; Calvin R. Cupp, Suffern, N.Y.

[73] Assignee: The International Nickel Company, Inc., New York, N.Y.

[22] Filed: Feb. 26, 1973

[21] Appl. No.: 335,711

[52] U.S. Cl. ..... 204/290 R; 204/291; 204/292; 204/293

[51] Int. Cl.[2] ..... C25B 11/02; C25D 17/12

[58] Field of Search ..... 204/292, , 290 R, 291; 75/.5

[56] References Cited

UNITED STATES PATENTS

| | | | |
|---|---|---|---|
| 2,392,708 | 1/1946 | Tschop | 204/292 X |
| 2,642,654 | 6/1953 | Ahrens | 204/16 X |
| 2,839,461 | 6/1958 | Renzoni et al. | 204/113 |
| 3,340,024 | 9/1967 | Mahan | 29/192 R |
| 3,592,693 | 7/1971 | Rosansky | 136/86 A |
| 3,775,273 | 11/1973 | Haines et al. | 204/115 |

FOREIGN PATENTS OR APPLICATIONS

| | | | |
|---|---|---|---|
| 1,071,438 | 12/1959 | Germany | 204/292 |
| 813,408 | 5/1959 | United Kingdom | 136/30 |

*Primary Examiner*—F. C. Edmundson
*Attorney, Agent, or Firm*—Francis J. Mulligan, Jr.; Ewan C. MacQueen

[57] ABSTRACT

A consumable electroplating anode comprises a compacted mass of metal powder having an additive dispersed throughout the mass, having an electrically conductive path through the mass and the mass having a density in excess of about 70% of theoretical density. The metal can be nickel, cobalt, iron, copper, cadmium or any other metal available in powder form and usable as a consumable anode. The additive can be either a solid or a liquid and can be an anode activator and/or a bath component. A specific structure wherein the additive is held by the metal in a compressed state at abnormally high density is also disclosed.

14 Claims, No Drawings

POWDER ANODE

The present invention is concerned with anodes for electrodeposition including electroplating, electroforming, etc., and, more particularly, with anodes for electroplating made of powdered metal.

In the electroplating art, there is a need for a means of providing consumable anode material which can be readily produced in any size or shape. The anode material must be electrochemically active and not produce excessive amounts of sludge during electrodissolution. Furthermore, it would be highly advantageous if an anode material were available which would enable an electroplater to automatically maintain the concentration of brighteners, levelers and other electroplating bath additives in his electroplating solutions. As far as we are aware, such an anode material has not been heretofore available in the art.

It has now been discovered that by means of a special composition of matter and a special process of making said composition of matter highly advantageous electroplating anodes can be provided.

It is an object of the present invention to provide a novel electroplating anode.

Another object of the present invention is to provide a novel process for the manufacture of said electroplating anode.

It is a further object of the present invention to provide a process of electroplating or electrodeposition employing the novel anode of the present invention.

Other objects and advantages will become apparent from the following description.

Generally speaking, the present invention contemplates as an article of manufacture an electroplating anode comprising a compacted mixture of metal powder and an additive having a continuous, electrically conductive path therethrough and having a density greater than about 70% of the theoretical density arrived at by arithmetically averaging the density of the metal powder and the density of the additive taking into account the relative proportions of each. For purposes of this specification and claims, the term "additive" is to be construed to include additives which electrochemically activate the metal in an electrolyte or additives which comprise a bath component or both of such types of additives.

While the present invention is particularly related to the provision of a novel nickel anode made from nickel powder, anodes of the present invention can be made from metals such as chromium, platinum, palladium, cobalt, iron, copper, cadmium, zinc, tin and alloys thereof and mixtures of such powders. When anodes are made from nickel, cobalt, and iron and mixtures thereof, it is advantageous to employ powders produced by the decomposition of the respective metal carbonyl compounds. As those skilled in the art are aware, metals produced by the decomposition of carbonyl compounds can be essentially pure metal or can contain small amounts of elements such as carbon, sulfur, halides, and oxygen. With respect to nickel, carbon, sulfur, halides and oxygen can act as activators for the electrochemical dissolution of the metal. Accordingly, it is within the contemplation of the present invention to include use of not only pure metal powder, but also metal powder which contains activating amounts of such elements. It is to be understood, however, that such activating amounts of sulfur, oxygen and the like are not necessary for the operability of the anodes of the present invention. Powders of metal such as copper, cadmium and the like, can be produced in known ways, for example, by the thermal decomposition of organo-metallic compounds or by the low temperature reduction of oxides using a gaseous reagent such as hydrogen. For use in anodes of the present invention, the metal powder should have a size within the range of about 0.1 micron to about 100 microns and advantageously at least part of the metal powder should be in non-spherical form in order to assure the production of a composite (metal-additive) anode which will have a continuous electrically conductive path therethrough.

As indicated hereinbefore, additives which are used in the anode of the present invention are either activators or additives which form a part of the electroplating bath. Additives inclusive in anodes of the present invention can be either solid or liquid at room temperature (i.e., the normal temperature of compaction). While all non-gaseous additive materials are contemplated within the ambit of the present invention, from a practical point of view, it is advantageous to use either an additive liquid at room temperature or an additive solid at room temperature and having a melting point in excess of about 65°C. It has been found with at least one solid additive melting at about 58°C. (butyne, 1,4 diol) the compacted anode containing 5% of the additive exuded additive material upon standing and was not as impact resistant as anodes made with liquids or higher melting solids.

The anodes of the present invention are employed in practice in complete or partial substitution for prior art anodes in conventional electrodeposition baths. Thus, for nickel one can employ conventional aqueous sulfate, sulfatechloride, sulfamate or fluoborate baths containing boric acid. For copper or iron deposition, conventional acid sulfate baths can be used. Details of other conventional electroplating baths employing consumable metal anodes are to be found in the literature, one well-known source, for example, being *Electroplating Engineering Handbook*, A. Kenneth Graham, Editor, Reinhold Publishing Corporation, 1955, Chapter 6, page 197 et seq.

When a metal subject to passivation in the electroplating bath to be used is used in the anode of the present invention, the anode must contain an activating additive. Using nickel as an example, nickel anodes in accordance with the present invention must contain an activator which advantageously is an alkali metal thiosulfate, e.g., sodium thiosulfate. Other activators include the chloride, fluoride, bromide and iodide salts of nickel, sodium, copper, cobalt, calcium, magnesium, lithium and potassium, oxygen-containing halide salts, such as chlorates, chlorites, hypochlorites, iodates, and the like of the same metals, nickel sulfide, sulfur, nickel oxide, carbon, boron, silicon and phosphorus. Those skilled in the art will appreciate that a particular electroplating bath additive must be carefully selected so as to be compatible with other ingredients of the bath. For example, in an electroplating bath from which it is desired to electrodeposit pure nickel, it is unlikely that one would select a copper salt as an activator for a nickel electrode because of the tendency for copper to co-deposit or deposit preferentially at the cathode. On the other hand, in an electroplating bath where the presence of copper is not detrimental or where an alloy deposit is desirable, a copper halide salt can act as an excellent activator for a nickel anode of the present invention. It has been found with sulfur-containing activators such as sodium thiosulfate, the activator performs a dual function. It not only activates the metal so as to cause it to dissolve at a low potential but it also reacts to form a conductive sulfide film at the anode surface. This sulfide film promotes more complete dissolution of the anode.

The second group of additives contemplated as a portion of the anodes of the present invention includes all kinds of materials, usually organic, (but sometimes inorganic, e.g. zinc ion as zinc sulfate in nickel electroplating) which in electroplating technology are referred to as "leveling agents", "brighteners", "addition agents", "buffers", "wetting agents", or the like. These include compounds which, in any way, improve the physical, chemical or mechanical characteristics of the cathode deposit when present in the electroplating bath. Members of this latter group of additives are usually soluble, at least to a limited extent in water or in the electroplating electrolyte in which they are to be used. As stated hereinbefore, the additives of this latter group can be solid or liquid with the preference being, if the additive is solid, that it have a melting point greater than about 65°C.

Anodes of the present invention can be fabricated from the metal powders in a variety of ways. For example, useful anodes can be made by either simply blending or by mechanical alloying of the metal powders with the additives. Mechanical alloying refers to the process described by J. S. Benjamin in U.S. Pat. No. 3,591,362 whereby an intimate dispersion of the additive in the metal powder can be achieved through high energy, dry milling. These powders can then be consolidated into a dense metallic compact by a thermomechanical treatment. For example, the powders can be first sealed in a metallic container and then either hot extruded, hot rolled, or hot compacted. For fabricating nickel anodes a hot working temperature of from about 870°C. (1600°F.) to about 1250°C. (2300°F.) can be used.

The above fabricating technique can not be applied to anodes which contain organic additives or other additives which decompose at elevated temperatures. These anodes can be made by simple blending of the additives with the metal powders followed by cold compaction at pressures generally in excess of about 10 kilograms per square millimeter. The mixed powders are compacted at a pressure of about 14 kilograms per square millimeter (kg/mm$^2$) to about 70 kg/mm$^2$, i.e., about 20 to about 100 thousands of pounds per square inch (k.s.i.) for about ½ to about 10 minutes into whatever shape is needed. For example, rods of anode material have been made by isostatic pressing mixtures of nickel, sodium thiosulfate and coumarin powders at a pressure of about 56.3 kg/mm$^2$. The pressed rods were then cut into disks for use in anode baskets. Cold-compaction methods other than isostatic pressing can also be used to make the anode of the present invention provided that at least about 28 kg/mm$^2$ pressure is effectively applied by the cold compaction method. With metals which do not give coherent metal-additive bodies on cold compaction, it is within the contemplation of the present invention to cold compact the metal, sinter the compacted metal and thereafter infiltrate the sintered compact with a solution or melt of the additive and thereafter further compact, if necessary, to achieve a theoretical density of at least 70% or, advantageously, 80%. Generally, however, this is not necessary because cold compaction at sufficiently high pressure can usually give an anode structure having sufficient mechanical strength to withstand the forces inherent in handling and in electroplating operations. When treating nickel powder and additive in accordance with the present invention and the nickel powder produced by decomposition of nickel carbonyl has an average particle size of about 4 to about 7 microns and comprises particles of very irregular shape, it is advantageous to cold compact at a pressure of at least about 20 kg/mm$^2$ when the isostatic method is used and about 25 kg/mm$^2$ when methods other than isostatic are used. When metal powders as deformable and irregularly shaped as carbonyl nickel powder, e.g., carbonyl iron powder and carbonyl cobalt powder, are used to make the anode of the present invention, relatively low pressures, for example, about 10 kg/mm$^2$ can be used to obtain a coherent body. Achievement of both a continuous electrical path through the anode and a relatively high degree of mechanical strength is facilitated by use of metal powder, the particles of which, advantageously, are nonspherical in nature or which are readily deformable from an initial spherical shape.

Some solid additives comprising bath components which are useful in the anodes of the present invention and U.S. patents in which they are disclosed are set forth in Table I.

TABLE I

| Bath Additive | U.S. Patent No. |
|---|---|
| Aromatic Sulfonamide Compounds | 2,191,813 |
| Organic Arsenic Acids | 2,211,535 |
| Unsaturated aliphatic sulfonamide | 2,466,677 |
| Aromatic sulfonesulfonic acids | 2,467,580 |
| Derivatives of ethylene glycol sulfates | 2,524,619 |
| Unsat. derivatives of quaternary salts | 2,647,866 |
| Coumarin and Coumarin derivatives | 2,635,076 |
| Urea and thiourea derivatives | 2,409,120 |
| Sulfonated polysulfide brighteners | 3,542,655 |
| Phosphate esters (for copper baths) | 3,269,925 |
| Unsaturated Carbamates | 3,429,789 |
| Aryl and alkyl sulfinates | 2,654,703 |
| Complex sulfones | 3,423,296 |
| Alkyne oxyalkyne carboxylic acids | 2,800,441 |
| Organo-substituted boranes | 3,563,864 |
| Substituted 1, 2 benzopyrones | 3,488,264 |

Some liquid additives disclosed in the art to be useful in electroplating baths and which can be employed in anodes of the present invention are set forth in Table IA along with the number of the U.S. patents in which the disclosure occurs.

TABLE IA

| Bath Additive | U.S. Patent No. |
|---|---|
| Triethanol amine | 2,107,806 |
| Ethyleneglycol monoethylether | 2,107,806 |
| Chloral acetal | 2,321,182 |
| Quinoline | 2,648,628 |
| Tetrahydrofurfuryl alcohol | 2,526,999 |
| Low mole weight polyethylene glycol | 2,784,152 |
| Methyl Acrylate | 2,690,996 |

Those skilled in the art will appreciate that the foregoing tabulated additives represent a random selection of substances disclosed to be useful in electroplating baths. All of such substances and others which do not react with metal powder during mixing and compaction are all effective for purposes of the present invention. In this regard, it is noted that thiourea appears to react with copper powder and nickel powder during blending and thus has not been found to be a fully satisfactory additive for purposes of the present invention.

The anodes of the present invention usually comprise approximately 80% to about 99.9% by weight of metal and about 0.1% to about 20% or more by weight of solid additives or about 90% to about 99.9% by weight of metal and about 0.1% to about 10% by weight of liquid additives. When formed as disclosed hereinbefore, the anode of the present invention containing larger amounts of additive, e.g., up to 70% by weight solid additive will often be approximately 100% dense or even have a density somewhat higher than 100% theoretical. It is to be observed, however, that porosity in an amount of up to about 20% or even 30% by volume of the anode can be tolerated.

While one can employ the anodes of the present invention as the only anodes in an electrodeposition process, they may also be employed in conjunction with normally used anodic materials. For example, in electroplating nickel having improved leveling and brightness characteristics, nickel anode material of the present invention in the form of disks can be used in conjunction with rounded pieces of sulfurdepolarized nickel made by electrolytic methods. A mix of anodes containing about 20 parts by weight of depolarized nickel rounds (disks) and about 1 part by weight of an anode material of the present invention containing about 94.5% nickel, about 0.5% activator and about 5% bath additive has been found to be effective in feeding a titanium anode basket employed in a Watts-type nickel plating bath. Generally speaking, when employing the anodes of the present invention containing bath additives, the anode material should be present in an amount such that release of additive material to the bath should be at about the same rate as consumption of additive in the bath. While various process parameters such as bath temperature, anode current density, cathode current density, hydrogen production at the cathode, release of active oxidizing species at the anode and the like can affect in one way or another the consumption of bath additives (particularly those organic additives having unsaturated linkages in the molecules), it has been found with respect to nickel plating using coumarin and saccharin as the bath additives that, very approximately, about 0.001 to about 0.01 gram of each additive is consumed for each gram of nickel plated. Thus, about 0.001 to about 0.01 gram of each additive should be released to the bath for each gram of nickel dissolved, assuming equal anode and cathode efficiency. Of course, the amount of additive to be released per each gram of metal dissolved will vary depending upon the metal being dissolved and the particular type of bath additive as well as the other parameters mentioned hereinbefore. Those skilled in the art will be able to readily determine their needs in this regard by periodic analysis of their electroplating baths.

As a caution it is to be observed that the present invention does not provide a solution to the problem of accumulation in the bath of undesirable products of reaction of additives. As those skilled in the nickel electroplating art are aware, accumulation of reaction products of brighteners inevitably occurs in bright nickel plating baths. Eventually, usually after about several thousand ampere-hours of plating, the accumulation of these undesirable products is sufficiently great so as to impair plating. Before this occurs, the bath should be purified such as by treatment with activated charcoal plus filtering. In such a purification process which is necessary when using the anodes of the present invention as well as in prior art bright plating methods, generally the desirable additives are absorbed on the charcoal along with the undesirable additive products. After such a purification process or at the start of a plating operation initial amounts of additives should be incorporated into the bath or the bath may be run with dummy or throwaway cathodes until the necessary brightener is dissolved from the anodes of the present invention.

For the purpose of giving those skilled in the art a better understanding and appreciation of the invention, the following Examples are given.

EXAMPLE I

Essentially pure nickel powder of the grade known as nickel 123 made by decomposition of nickel carbonyl and having an average particle size of about 8 microns was blended along with 0.5% by weight of anhydrous sodium thiosulfate powder and 5.0% by weight of coumarin powder. The blended powders were then isostatically compacted at about 56.3 kg/mm$^2$ for about 5 minutes. The resultant compacted bar had a density of about 6.3 grams/cm$^3$. Disks cut from the compacted bar functioned well as consumable anodes in an aqueous nickel plating bath along with electroformed active nickel disks and released coumarin into the bath as they were electrochemically corroded.

Table II contains pertinent data concerning additional anodes of the present invention made in a manner similar to the anode of Example I.

TABLE II

| Example | Metal | | Activator | | Bath Additive | | Compaction | | Density | Remarks |
|---|---|---|---|---|---|---|---|---|---|---|
| | | | | | | | Pressure | Time | | |
| No. | Kind | % (Wt.) | Kind | % (Wt.) | Kind | % (Wt.) | kg/mm$^2$ | min. | g/cc | |
| 2 | Ni | 94.5 | Na Thiosulfate | 0.5 | Saccharin* | 5 | 56.3 | 5 | 6.5 | *Na Derivative |
| 3 | Ni | 94.5 | Na Thiosulfate | 0.5 | Acetanilide | 5 | 49.2 | 5 | 6.13 | |
| 4 | Ni | 94.5 | Na Thiosulfate | 0.5 | Piperonal | 5 | 49.2 | 5 | 6.96 | |
| 5 | Ni | 94.5 | Na Thiosulfate | 0.5 | Phthalimide | 5 | 49.2 | 5 | 6.32 | |
| 6 | Ni | 94.5 | Na Thiosulfate | 0.5 | Vanillin | 5 | 49.2 | 5 | 5.98 | |
| 7 | Ni | 94.5 | Na Thiosulfate | 0.5 | P-toluene sulfonamide | 5 | 49.2 | 5 | 6.17 | |
| 8 | Ni | 94.5 | Na Thiosulfate | 0.5 | Basic Fuchsin | 5 | 49.2 | 5 | 5.55 | |
| 9 | Ni | 94.5 | Na Thiosulfate | 0.5 | Nicotinamide | 5 | 49.2 | 5 | 6.09 | |
| 10 | Ni | 94.5 | Na Thiosulfate | 0.5 | Trimethyl phenyl Ammonium Iodide | 5 | 49.2 | 5 | 6.51 | |
| 11 | Ni | 94.5 | Na Thiosulfate | 0.5 | 2-butyne 1,4 diol | 5* | 49.2 | 5 | 6.33 | *Amount added Some Exuded |
| 12 | Ni | 94.5 | Na Thiosulfate | 0.5 | P-toluene sulfonic Acid Na Salt | 5 | 49.2 | 5 | 6.08 | |
| 13 | Ni | 94.5 | Na Thiosulfate | 0.5 | Chloral Hydrate | 5 | 49.2 | 5 | 6.81 | |
| 14 | Ni | 94.5 | Na Thiosulfate | 0.5 | Thiourea | 5 | 49.2 | 5 | 6.13 | |

TABLE II-continued

| Example No. | Metal Kind | Metal % (Wt.) | Activator Kind | Activator % (Wt.) | Bath Additive Kind | Bath Additive % (Wt.) | Compaction Pressure kg/mm² | Compaction Time min. | Density g/cc | Remarks |
|---|---|---|---|---|---|---|---|---|---|---|
| 15 | Cu | 95 | — | — | Thiourea | 5 | 49.2 | 5 | 6.86 | |
| 16 | Cu | 95 | — | — | Phenosafranine | 5 | 49.2 | 5 | 6.28 | |
| 17 | Cd | 95 | — | — | Hematein | 5 | 49.2 | 5 | 6.94 | |
| 18 | Ni | 98.5 | Na Thiosulfate | 0.5 | Pyridine | 1 | 49.2 | 5 | 7.33 | |
| 19 | Ni | 98.5 | Na Thiosulfate | 0.5 | Quinoline | 1 | 49.2 | 5 | 7.25 | |
| 20 | Ni | 97.5 | Na Thiosulfate | 0.5 | Quinoline | 2 | 49.2 | 5 | 7.22 | |
| 21 | Ni | 96.5 | Na Thiosulfate | 0.5 | Quinoline | 3 | 49.2 | 5 | 7.27 | |
| 22 | Ni | 94.5 | Na Thiosulfate | 0.5 | Chloroquinoline | 5 | 49.2 | 5 | 6.56 | |
| 23 | Ni | 99 | — | — | Pyridine | 1 | 49.2 | 5 | 7.34 | |
| 24 | Ni | 96.5 | Na Thiosulfate | 0.5 | Pyridine | 3 | 49.2 | 5 | 7.19 | |
| 25 | Ni | 93.5 | Na Thiosulfate | 0.5 | Pyridine | 6 | 49.2 | 5 | 6.70 | |
| 26 | Ni | 98.5 | Na Thiosulfate | 0.5 | Saccharin* | 1 | 14.1 | 5 | 5.94 | *Na Derivative |
| 27 | Ni | 98.5 | Na Thiosulfate | 0.5 | Saccharin* | 1 | 35.2 | 5 | 6.69 | *Na Derivative |
| 28 | Ni | 98.5 | Na Thiosulfate | 0.5 | Saccharin* | 1 | 49.2 | 5 | 7.13 | *Na Derivative |
| 29 | Cu | 98.5 | — | — | Jaguar Plus* | 1 | 21.1 | 5 | 6.30 | *Cationic Guar Gum Derivative sold by Stein Hall Co. |
| 30 | Cu | 98.5 | — | — | Jaguar plus* | 1 | 35.2 | 5 | 6.94 | * " |
| 31 | Cu | 98.5 | — | — | Jaguar plus* | 1 | 49.2 | 5 | 7.31 | * " |
| 32 | Ni | 89.5 | Na Thiosulfate | 0.5 | Saccharin* | 10 | 49.2 | 5 | 5.70 | *Na Derivative |
| 33 | Ni | 84.5 | Na Thiosulfate | 0.5 | Saccharin* | 15 | 49.2 | 5 | 5.05 | *Na Derivative |
| 34 | Ni | 79.5 | Na Thiosulfate | 0.5 | Saccharin* | 20 | 49.2 | 5 | 4.90 | *Na Derivative |
| 35 | Ni | 74.5 | Na Thiosulfate | 0.5 | Saccharin* | 25 | 49.2 | 5 | 4.18 | *Na Derivative |
| 36 | Ni | 69.5 | Na Thiosulfate | 0.5 | Saccharin* | 30 | 49.2 | 5 | 4.38 | *Na Derivative |
| 37 | Ni | 59.5 | Na Thiosulfate | 0.5 | Saccharin* | 40 | 49.2 | 5 | 3.60 | *Na Derivative |
| 38 | Ni | 94.5 | Na Thiosulfate | 0.5 | Coumarin | 5 | 49.2 | 5 | 6.13 | |
| 39 | Ni | 89.5 | Na Thiosulfate | 0.5 | Coumarin | 10 | 49.2 | 5 | 4.99 | |
| 40 | Ni | 39.5 | Na Thiosulfate | 0.5 | Coumarin | 60 | 49.2 | 5 | 2.77 | |

All the articles of manufacture described in Table II are sufficiently impact resistant so as to have utility as anodes in electroplating baths and all exhibit a continuous, electrically conductive path therethrough. The electrical resistance of masses of the articles of Table II are within the range of about $0.1 \times 10^{-4}$ ohm-centimeters ($0.07 \times 10^{-4}$ ohm-centimeters for Example 17) to about $500 \times 10^{-4}$ ohm-centimeters ($470 \times 10^{-4}$ ohm-centimeters for Example 16). The percents theoretical density of the examples of Table II are in the range of about 70% (73% for Example 26) to about 140% (137% for Example 40). The fact that the percent theoretical density exceeds 100% for certain examples of the present invention, e.g., Examples 25, 36, 37, and 40, indicates that at least for these examples the metal of the article has the ability to hold the additive, or other compressible material, in a state of compression such that the compressible material in the compact exhibits a significantly higher, e.g., greater than 5% higher, apparent density than the normal density of the material. As an illustration, the density of coumarin in the article of Example 40, by calculation, is about 1.91 g/c.c. based upon a compact density measured at room temperature. Measurement of the density of the particular batch of coumarin used in the present work shows its ordinary density to be about 1.33 g/c.c. Thus, in Example 40, after all external compressive forces have been removed from the compact, internal compressive forces apparently hold the coumarin in a state whereby its density is about 42% greater than its normal density. This effect is not limited to coumarin but rather, as indicated by the data in Table II is also exhibited by a crystalline solid, i.e., sodium saccharin and by a mobile liquid, i.e., pyridine.

Because, insofar as applicants are aware, metal-compressible material compacts such as Examples 25, 36, 37, and 40 having the compressible material in a density state significantly higher than normal have not been known heretofore, it is a supplementary object of the present invention to provide such compacts for use both as electro-plating anodes and as articles of manufacture having various other utilities.

With regard to materials wherein a nickel powder matrix encloses a compressible material, experiments have shown with saccharin and coumarin that maximum density of the additive occurs at about 60% by weight of additive and about 40% by weight of metal when the material is compressed under isostatic conditions at 49.2 kg/mm² for 5 minutes. The calculated density of the additive decreased at both lower and higher percentages decreasing at about 80% by weight of additive to about 100% of theoretical or lower. Up to 60% by weight of additive, the metal-additive object retains substantial electrical conductivity indicative of a continuous metal matrix. For example, at 60% saccharin, a nickel compact has a resistivity of about $127 \times 10^{-4}$ ohm-centimeters and at 60% coumarin, a nickel compact has a resistivity of about $52 \times 10^{-4}$ ohm-centimeters. At 80% of either of these additives the nickel compact is not electrically conductive indicative of the loss of continuity of metal in the compact.

A study was made of nickel anodes containing 1% saccharin as an additive to show the effect of isostatic compaction pressure on density and electrical conductivity. Three anodes of this kind within the scope of the present invention are set forth hereinbefore as examples 26 to 28. At compaction pressures below about 10 kg/mm², anode density is low and resistivity fairly high. At pressures above about 10 kg/mm² the density appears to be directly related to compaction pressure at least in the range of 10 kg/mm² (70% theoretical density to 49.2 kg/mm² (89% theoretical density). Above about 25 kg/mm² and up to about 50 kg/mm² pressure, the electrical resistivity appears to be constant at about $0.6 \times 10^4$ ohm-centimeters.

In addition of those Examples of the anodes of the present invention set forth in Table II, anodes were also made as follows:

EXAMPLE 41

A material mix as prepared for Example I was compacted in a die having the shape of a disc under a load of 28,500 kilograms to provide an overall average pressure of 56.3 kg/mm$^2$ on the mixture. The product had a density of about 5.87 grams/cm$^3$ i.e., about 94% of theoretical.

The anodes of the present invention are fully operable in electroplating practice and can be used in conventional aqueous electroplating baths as well as in other electroplating baths which can include other solvents in place of all or part of the water.

EXAMPLE 42

Disks of the anode of Example I were mixed with electroformed nickel rounds and placed in a titanium basket. Disks of the anode of Example II were treated similarly. Both baskets were placed within cotton duck bags and each placed at opposite ends of a ten liter standard Watts nickel plating bath. A mild steel cathode was placed between the anode baskets and plating was begun at a temperature of 60°C., (about 140°F.), a pH of 4.0 and a cathode current density of about 5.4 amperes per square decimeter (a/dm$^2$). After a time coumarin and saccharin derived from the anodes of the present invention increased in concentration in the bath to a point where bright nickel was plated in place of gray nickel initially deposited. Periodic addition of anodes of the present invention permitted plating of bright nickel for about 7700 ampere hours, i.e., a nickel deposition of about 8600 grams. Use of sodium thiosulfate as the activator in the anodes in Example I and II is highly advantageous in that in a Watts bath, a conductive sulfide film forms around these anodes (and others containing sodium thiosulfate) thereby limiting the formation of sludge.

EXAMPLE 43

A charge of 1000 parts by weight of nickel 123 powder, 2 parts by weight of graphite, 2.5 parts by weight of minus 325 mesh silicon powder and 1.83 parts by weight of anhydrous nickel chloride was mechanically alloyed for 16 hours in an attritor, hot compacted at about 980°C. and hot worked at about 1040°C. to provide a plate about 13 mm. thick. The thus produced nickel anode containing about 0.15% of activating ingredients dissolved in a satisfactory manner at an anode current density of about 2.15 amperes per square decimeter in a standard Watts electrolyte having a pH of 4.0 and maintained at a temperature of about 60°C.

EXAMPLE 44

Similar results to those set forth in Example 43 were obtained with an anode made with a charge of 4000 parts by weight of nickel 123 powder and about 33 parts by weight of sodium chloride. The charge was blended to provide a uniform powder mixture and thereafter extruded at about 980°C. to provide an anode having a chlorine content of about 0.52%.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A consumable electroplating anode comprising a cold compacted mass of powder of electrodepositable metal selected from the group consisting of nickel, cobalt, iron, copper, chromium, platinum, palladium, cadmium, zinc, tin and alloys and mixtures thereof having a. at least one additive from the group consisting of electrode activators and electroplating bath additives dispersed therethrough b. a continuous metallic path therethrough and c. a density of at least 70% of theoretical.

2. A consumable electroplating anode as in claim 1 wherein the additive comprises about 0.1% to about 70% by weight of the anode.

3. A consumable electroplating anode as in claim 1 wherein the electrodepositable metal is nickel.

4. A consumable electroplating anode as in claim 1 wherein the electrodepositable metal is copper.

5. A consumable electroplating anode as in claim 1 wherein the electrodepositable metal is cadmium.

6. A consumable electroplating anode as in claim 1 wherein the additive is an electrode activator.

7. A consumable electroplating anode as in claim 1 wherein the additive is an electroplating bath component.

8. A consumable electroplating anode as in claim 1 wherein the additive is a solid present in the anode in an amount of about 0.1% to about 70% by weight.

9. A consumable electroplating anode as in claim 8 wherein the solid additive has a melting point in excess of about 65°C.

10. A consumable electroplating anode as in claim 1 wherein the additive is a liquid present in the anode in an amount of about 0.1 to about 10% by weight.

11. A consumable electroplating anode as in claim 3 wherein the additive comprises an anode activator and a bath component.

12. A consumable electroplating anode as in claim 11 wherein the anode activator is a sulfur-containing material.

13. A consumable electroplating anode as in claim 12 wherein the anode activator is sodium thiosulfate.

14. A consumable electroplating anode as in claim 1 wherein the density is at least 80% theoretical.

* * * * *